US009470063B2

(12) United States Patent
Stewart et al.

(10) Patent No.: US 9,470,063 B2
(45) Date of Patent: Oct. 18, 2016

(54) WELL INTERVENTION PRESSURE CONTROL VALVE

(71) Applicant: Halliburton Energy Services, Inc., Houston, TX (US)

(72) Inventors: Takao Stewart, Chickasha, OK (US); Eric Bivens, Seacliff (AU); Timothy Holiman Hunter, Duncan, OK (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 14/859,954

(22) Filed: Sep. 21, 2015

(65) Prior Publication Data

US 2016/0010428 A1 Jan. 14, 2016

Related U.S. Application Data

(63) Continuation of application No. 13/745,116, filed on Jan. 18, 2013, now abandoned.

(51) Int. Cl.

| | |
|---|---|
| ***E21B 34/10*** | (2006.01) |
| ***E21B 34/06*** | (2006.01) |
| ***E21B 34/14*** | (2006.01) |

(Continued)

(52) U.S. Cl.

CPC ..... *E21B 34/102* (2013.01); *E21B 34/06* (2013.01); *E21B 34/103* (2013.01); *E21B 34/12* (2013.01); *E21B 34/14* (2013.01); *E21B 2034/005* (2013.01)

(58) Field of Classification Search

USPC ..... 175/318, 332.8, 334.1, 386, 319

See application file for complete search history.

(56) References Cited

U.S. PATENT DOCUMENTS

| | | | |
|---|---|---|---|
| 2,921,601 | A | 1/1960 | Fisher, Jr. |
| 3,148,731 | A | 9/1964 | Holden |
| 3,220,481 | A | 11/1965 | Park |

(Continued)

FOREIGN PATENT DOCUMENTS

| | | |
|---|---|---|
| EP | 2108780 | 10/2009 |
| GB | 2163795 | 3/1986 |

(Continued)

OTHER PUBLICATIONS

Office Action dated Apr. 3, 2013 {31 pages), U.S. Appl. No. 13/087,810 filed Apr. 15, 2011.

(Continued)

*Primary Examiner* — David Andrews
*Assistant Examiner* — Kyle Armstrong
(74) *Attorney, Agent, or Firm* — Haynes and Boone, LLP

(57) ABSTRACT

A system comprising a control valve comprising a flapper either activated or inactivated, when activated the flapper may be closed or open and, when inactivated the flapper is open, a first sleeve transitional from a first to a second position, and a second sleeve transitional from a first to a second position, when the first and second sleeves are in the first position, the flapper is activated, when the first sleeve is in the second and the second sleeve is in the first position, the flapper is inactivated, when the first and second sleeves are in the second position, the flapper is activated, the application of pressure to the first sleeve via a first member transitions the first sleeve from the first to the second position, and the application of pressure to the second sleeve via a second member transitions the second sleeve from the first to the second position.

13 Claims, 5 Drawing Sheets

(51) Int. Cl.

| | |
|---|---|
| ***E21B 34/12*** | (2006.01) |
| *E21B 34/00* | (2006.01) |

(56) References Cited

U.S. PATENT DOCUMENTS

| | | | | |
|---|---|---|---|---|
| 3,481,397 | A | 12/1969 | Baker | |
| 3,799,258 | A | 3/1974 | Tausch | |
| 3,955,624 | A | 5/1976 | Fredd et al. | |
| 3,967,647 | A | 7/1976 | Young | |
| 4,058,165 | A | 11/1977 | Holden et al. | |
| 4,154,303 | A | 5/1979 | Fournier | |
| 5,044,443 | A | 9/1991 | Churchman et al. | |
| 5,803,177 | A | 9/1998 | Hriscu et al. | |
| 5,819,853 | A | 10/1998 | Patel | |
| 6,158,516 | A | 12/2000 | Smith et al. | |
| 6,196,325 | B1 | 3/2001 | Connell et al. | |
| 6,253,842 | B1 | 7/2001 | Connell et al. | |
| 6,305,467 | B1 | 10/2001 | Connell et al. | |
| 6,390,199 | B1 | 5/2002 | Heijnen | |
| 6,401,824 | B1 | 6/2002 | Musselwhite et al. | |
| 6,508,309 | B1 | 1/2003 | French | |
| 6,679,336 | B2 | 1/2004 | Musselwhite et al. | |
| 6,688,389 | B2 | 2/2004 | Connell et al. | |
| 6,712,145 | B2 | 3/2004 | Allamon | |
| 6,808,023 | B2 | 10/2004 | Smith et al. | |
| 6,877,558 | B2 | 4/2005 | Connell et al. | |
| 6,907,936 | B2 | 6/2005 | Fehr et al. | |
| 7,134,488 | B2 | 11/2006 | Tudor et al. | |
| 7,168,492 | B2 * | 1/2007 | Laplante | E21B 21/10 166/319 |
| 7,246,668 | B2 | 7/2007 | Smith | |
| 7,337,852 | B2 | 3/2008 | Manke et al. | |
| 7,405,998 | B2 | 7/2008 | Webb et al. | |
| 7,648,179 | B2 | 1/2010 | Webb et al. | |
| 7,678,744 | B2 | 3/2010 | Abney et al. | |
| 7,832,482 | B2 | 11/2010 | Cavender et al. | |
| 7,866,400 | B2 | 1/2011 | Steele et al. | |
| 7,963,342 | B2 | 6/2011 | George | |
| 8,096,362 | B2 | 1/2012 | Steele et al. | |
| 8,267,172 | B2 | 9/2012 | Surjaatmadja et al. | |
| 8,276,676 | B2 | 10/2012 | Hriscu et al. | |
| 8,307,898 | B2 | 11/2012 | Johnson et al. | |
| 8,397,823 | B2 | 3/2013 | Xu | |
| 2002/0033262 | A1 | 3/2002 | Musselwhite et al. | |
| 2003/0047315 | A1 * | 3/2003 | Allamon | E21B 21/10 166/332.8 |
| 2006/0124310 | A1 * | 6/2006 | Lopez de Cardenas | E21B 34/06 166/313 |
| 2012/0097396 | A1 | 4/2012 | Stewart et al. | |
| 2012/0261136 | A1 | 10/2012 | Ehtesham et al. | |
| 2013/0075111 | A1 | 3/2013 | Ellis | |

FOREIGN PATENT DOCUMENTS

| | | |
|---|---|---|
| WO | WO 9919602 | 4/1999 |
| WO | WO 2011104516 A2 | 9/2011 |
| WO | WO 2011104516 A3 | 9/2011 |
| WO | WO 2011104516 A8 | 9/2011 |

OTHER PUBLICATIONS

Foreign communication from a related counterpart application—International Search Report and Written Opinion, PCT/ GB2011/000265, Mar. 26, 2012, 11 pages_.

Foreign communication from a related counterpart application—International Preliminary Report on Patentability, PCT/ GB2011/000265, Aug. 28, 2012, 7 pages_.

Office Action {Final) dated Oct. 2, 2013 {17 pages), U.S. Appl. No. 13/087,810, filed Apr. 15, 2011.

* cited by examiner

WELL INTERVENTION PRESSURE CONTROL VALVE

CROSS-REFERENCE TO RELATED APPLICATIONS

This application claims the benefit of the filing date of, and priority to, U.S. patent application Ser. No. 13/745,116, filed Jan. 18, 2013, the entire disclosure of which is hereby incorporated herein by reference.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Hydrocarbon-producing wells often are stimulated by hydraulic fracturing operations, during which a servicing fluid such as a fracturing fluid or a perforating fluid may be introduced into a portion of a subterranean formation penetrated by a wellbore at a hydraulic pressure sufficient to create or enhance at least one fracture therein. Such a subterranean formation stimulation treatment may increase hydrocarbon production from the well.

A work string (e.g., tool string, coiled tubing string, and/or segmented tool string) is often used to communicate fluid to and from the subterranean formation, for example, during a wellbore stimulation (e.g., a hydraulic fracturing) operation. For example, jointed tubing may be used to form at least a portion of the work string. Additionally or alternatively, coiled tubing may also be used to form at least a portion of the work string.

Sometimes, during the performance of a wellbore servicing operation, it may be desirable to fluidicly isolate two or more sections of the work string (e.g. between a coiled tubing string and a jointed tubing string), for example, so as to close off fluid and/or pressure communication through the work string flowbore in at least one direction. For example, closing off fluid communication through a work string flowbore may allow, as an example, for the isolation of well pressure within the work string flowbore during run-in and/or run-out of a work string (e.g., facilitating connection and/or disconnection of one or more work string sections, such as a jointed tubing section and a coiled tubing section, two or more sections of jointed tubing, or combinations thereof). As such, there is a need for apparatuses, system, and methods of selectively allowing and/or preventing fluid communication through the flowbore of a work string during the performance of a wellbore servicing operation.

SUMMARY

Disclosed herein is a wellbore servicing system comprising a work string, and a pressure control valve tool incorporated within the work string and comprising a housing generally defining an axial flowbore, a flapper valve disposed within the axial flowbore and configurable between an activated state and an inactivated state, wherein, in the activated state the flapper valve is free to move between a closed position in which the flapper valve blocks the axial flowbore and an open position in which the flapper valve does not block the axial flowbore, and wherein, in the inactivated state the flapper valve is retained in the open position, a first sleeve slidably positioned within the housing and transitional from a first position to a second position with respect to the housing, and a second sleeve slidably positioned within the first sleeve and transitional from a first position to a second position with respect to the first sleeve, wherein, when the first sleeve is in the first position with respect to the housing and the second sleeve is in the first position with respect to the first sleeve, the flapper valve is in the activated state, wherein, when the first sleeve is in the second position with respect to the housing and the second sleeve is in the first position with respect to the first sleeve, the flapper valve is in the inactivated state, wherein, when the first sleeve is in the second position with respect to the housing and the second sleeve is in the second position with respect to the first sleeve, the flapper valve is in the activated state, and wherein, engagement of a first obturating member with the first sleeve and the application of a pressure of at least a threshold pressure onto the first obturating member causes the first sleeve to transition from the first position to the second position with respect to the housing and such that the engagement of a second obturating member with the second sleeve and the application of a pressure of at least a threshold pressure onto the second obturating member causes the second sleeve to transition from the first position to the second position with respect to the first sleeve.

Also disclosed herein is a wellbore servicing method comprising positioning a work string comprising a pressure control valve tool (PCVT) in a first configuration incorporated therein within a wellbore, wherein in the first configuration the PCVT provides unidirectional fluid flow through the work string, introducing of a first obturating member within the PCVT and applying at least a pressure threshold onto the first obturating member thereby allowing bidirectional fluid communication through the work string, introducing of a second obturating member within the PCVT and applying of at least a pressure threshold onto the second obturating member thereby allowing unidirectional fluid communication, removing the working string comprising the PCVT from the wellbore.

Further disclosed herein is a wellbore servicing method comprising positioning a work string comprising a pressure control valve tool (PCVT) in a first configuration incorporated therein within a wellbore, wherein, the PCVT is configurable from the first configuration to a second configuration and from the second configuration to a third configuration, wherein, when the PCVT is in the first configuration, the PCVT is configured to allow a route of fluid communication in a down-hole direction and to disallow a route of fluid in an up-hole direction via the PCVT, wherein, when the PCVT is in the second configuration, the PCVT is configured to allow bidirectional fluid communication via the PCVT, and wherein, when the PCVT is in the third configuration, the PCVT is configured to allow a route of fluid communication in a down-hole direction and to disallow a route of fluid in an up-hole direction via the PCVT, transitioning the PCVT from the first configuration to the second configuration thereby allowing bidirectional fluid communication through the work string, transitioning the PCVT from the second configuration to the third configuration thereby allowing unidirectional fluid communication, and removing the working string comprising the PCVT from the wellbore.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
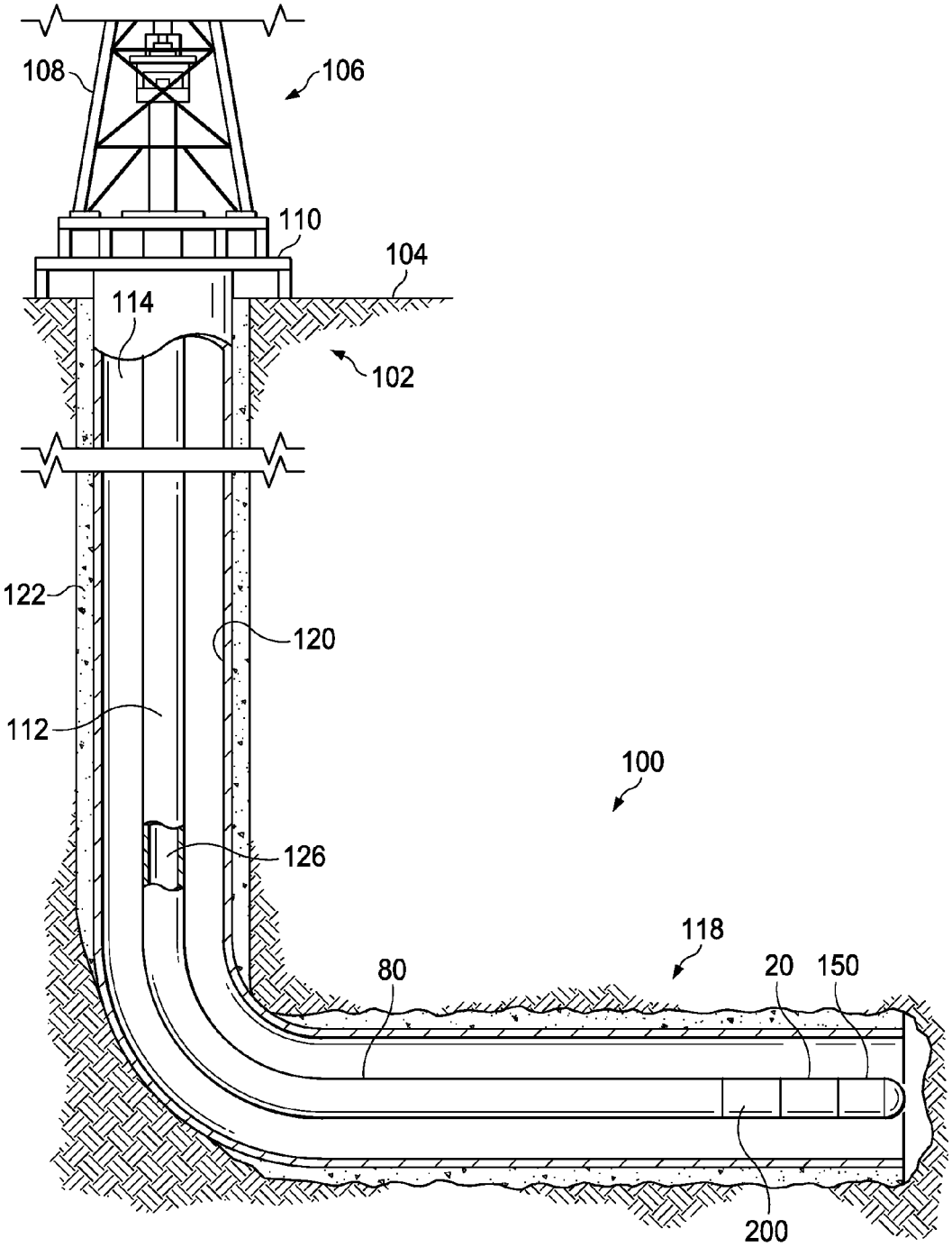
FIG. 1 is a partial cutaway view of an embodiment of an operating environment associated with a pressure control valve tool.

In the drawings and description that follow, like parts are typically marked throughout the specification and drawings with the same reference numerals, respectively. In addition, similar reference numerals may refer to similar components in different embodiments disclosed herein. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is not intended to limit the invention to the embodiments illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "up-hole," "upstream," or other like terms shall be construed as generally from the formation toward the surface or toward the surface of a body of water; likewise, use of "down," "lower," "downward," "down-hole," "downstream," or other like terms shall be construed as generally into the formation away from the surface or away from the surface of a body of water, regardless of the wellbore orientation. Use of any one or more of the foregoing terms shall not be construed as denoting positions along a perfectly vertical axis.

Unless otherwise specified, use of the term "subterranean formation" shall be construed as encompassing both areas below exposed earth and areas below earth covered by water such as ocean or fresh water.

Disclosed herein are embodiments of wellbore servicing apparatuses, systems and methods of using the same. Particularly disclosed herein are one or more embodiments of a pressure control valve tool (PCVT), systems, and methods utilizing the same. In one or more of the embodiments as will be disclosed herein, the PCVT may be generally configured to selectively transition through one or more configurations so as to selectively allow and/or disallow fluid communication through a tubular string (e.g., a work string) in one or both directions, for example, during the performance of a wellbore servicing operation (e.g., a subterranean formation stimulation operation).

Referring to FIG. 1, an embodiment of an operating environment in which such a PCVT and/or a wellbore servicing system comprising such a PCVT may be employed is illustrated. As depicted in FIG. 1, the operating environment generally comprises a wellbore 114 that penetrates a subterranean formation 102 for the purpose of recovering hydrocarbons, storing hydrocarbons, disposing of carbon dioxide, or the like. The wellbore 114 may be drilled into the subterranean formation 102 using any suitable drilling technique. In an embodiment, a drilling or servicing rig 106 disposed at the surface 104 comprises a derrick 108 with a rig floor 110 through which a work string (e.g., a drill string, a tool string, a segmented tubing string, a jointed tubing string, or any other suitable conveyance, or combinations thereof) generally defining an axial flow bore 126 may be positioned within or partially within wellbore 114. In an embodiment, such a work string may comprise two or more concentrically positioned strings of pipe or tubing (e.g., a first work string may be positioned within a second work string). The drilling or servicing rig may be conventional and may comprise a motor driven winch and other associated equipment for lowering the work string into wellbore 114. Alternatively, a mobile workover rig, a wellbore servicing unit (e.g., coiled tubing units), or the like may be used to lower the work string into the wellbore 114. In such an embodiment, the work string may be utilized in drilling, stimulating, completing, or otherwise servicing the wellbore, or combinations thereof.

The wellbore 114 may extend substantially vertically away from the earth's surface over a vertical wellbore portion, or may deviate at any angle from the earth's surface 104 over a deviated or horizontal wellbore portion 118. In alternative operating environments, portions or substantially all of wellbore 114 may be vertical, deviated, horizontal, and/or curved and such wellbore may be cased, uncased, or combinations thereof. In some instances, at least a portion of the wellbore 114 may be lined with a casing 120 that is secured into position against the formation 102 in a conventional manner using cement 122. In this embodiment, the deviated wellbore portion 118 includes casing 120. However, in alternative operating environments, the wellbore 114 may be partially cased and cemented thereby resulting in a portion of the wellbore 114 being uncased. In an embodiment, a portion of wellbore 114 may remain uncemented, but may employ one or more packers (e.g., mechanical and/or swellable packers, such as Swellpackers™, commercially available from Halliburton Energy Services, Inc.) to isolate two or more adjacent portions or zones within wellbore 114. It is noted that although some of the figures may exemplify a horizontal or vertical wellbore, the principles of the apparatuses, systems, and methods disclosed may be similarly applicable to horizontal wellbore configurations, conventional vertical wellbore configurations, and combinations thereof. Therefore, the horizontal or vertical nature of any figure is not to be construed as limiting the wellbore to any particular configuration.

Referring to FIG. 1, a wellbore servicing system 100 is illustrated. In the embodiment of FIG. 1, the wellbore servicing system 100 comprises a PCVT 200 incorporated with a work string 112 and positioned within the wellbore 114. Additionally, in an embodiment the wellbore servicing system 100 may further comprise a wellbore servicing tool 150. In such an embodiment, the wellbore servicing tool 150 may be incorporated within the work string 112, for example, at a position relatively downhole from the PCVT 200. Also, in such an embodiment, the work string 112 may be positioned within the wellbore 114 such that the wellbore servicing tool 150 is positioned proximate and/or substantially adjacent to one or more zones of the subterranean formation 102.

The wellbore servicing tool 150 may be generally configured to deliver a wellbore servicing fluid to the wellbore 114, the subterranean formation 102 and/or one or more zones thereof, for example, for the performance of one or more servicing operations. For example, the wellbore servicing tool 150 may generally comprise a stimulation tool (such as a fracturing, perforating tool, and/or acidizing tool), a drilling tool (such as a drill bit), a wellbore cleanout tool, or combinations thereof. While this disclosure may refer to a wellbore servicing tool 150 configured for a stimulation operation (e.g., a perforating and/or fracturing tool), as disclosed herein, a wellbore servicing tool incorporated with the wellbore servicing system may be configured for various additional or alternative operations and, as such, this disclosure should not be construed as limited to utilization in any particular wellbore servicing context unless so-designated. In an embodiment, the wellbore servicing tool 150 may be selectively actuatable, for example, being configured to provide or not provide a route of fluid communication from the wellbore servicing tool 150 to the wellbore 114, the subterranean formation 102, and/or a zone thereof. In such an embodiment, the wellbore servicing tool 150 may be configured for actuation via the application of fluid pressure to the wellbore servicing tool 150, via the operation of a ball or dart, via the operation of a shifting tool (e.g., a wireline tool), or combinations thereof, as will be appreciated by one of skill in the art upon viewing this application. Although the embodiment of FIG. 1 illustrates a single wellbore servicing tool 150 (e.g., being positioned substantially proximate or adjacent to a formation), one of skill in the art viewing this disclosure will appreciate that any suitable number of wellbore servicing tools may be similarly incorporated within a work string 112, for example, 2, 3, 4, 5, 6, 7, 8, 9, 10, etc. wellbore servicing tools.

In the embodiment of FIG. 1, the work string 112 comprises at least one segment of jointed tubing 20 (e.g., a "joint"). For example, in the embodiment of FIG. 1, the jointed tubing 20 may be coupled to the PCVT 200 and may comprise a portion of the work string 112 relatively downhole from the PCVT 200. Not intending to be bound by theory, the jointed tubing 20 may provide a relatively strong, reliable work string flowbore 126 at the location of the stimulation operation. For example, the wellbore servicing tool 150 may be incorporated within the jointed tubing 20 portion of the work string 112. Additionally, in an embodiment, the wellbore servicing system 100 may further comprise at least one segment of coiled tubing 80. For example, in the embodiment of FIG. 1, the coiled tubing 80 may be coupled to the PCVT 200 and may comprise a portion of the work string 112 relatively uphole from the valve tool 200. Not intending to be bound by theory, the coiled tubing 80 may allow for the work string 112 to be quickly and easily moved uphole or downhole within the wellbore 114 (e.g., to be quickly and easily "run-in" or "run-out" of the wellbore 114). While in the embodiment of FIG. 1, jointed tubing 20 is coupled to and located downhole from the PCVT 200 and coiled tubing 80 is coupled to and located uphole from the PCVT 200, in other embodiments, various suitable additional or alternative configurations may be similarly employed. For example, in alternative embodiments, jointed tubing 20 may be located uphole from the PCVT 200 and/or coiled tubing 80 may be located downhole from the valve tool 200. Furthermore, in yet another embodiment, the jointed tubing 20 or coiled tubing 80 may be located both uphole and downhole from the PCVT 200 (e.g., comprising substantially all of the work string 112).

Additionally, although the embodiment of FIG. 1 illustrates a wellbore servicing system 100 comprising the PCVT 200 incorporated within a work string 112, a similar wellbore servicing system may be similarly incorporated within any other suitable type of string (e.g., a drill string, a tool string, a segmented tubing string, a jointed tubing string, a casing string, a coiled-tubing string, or any other suitable conveyance, or combinations thereof), working environment, or configuration, as may be appropriate for a given servicing operation. Also, although the embodiment of FIG. 1 illustrates a single PCVT 200, one of skill in the art viewing this disclosure will appreciate that any suitable number of PCVTs, as will be disclosed herein, may be similarly incorporated within a work string 112, for example, 2, 3, 4, 5, etc. PCVTs.

In one or more of the embodiments disclosed herein, one or more PCVTs 200 may be configured to be activated while disposed within a wellbore like wellbore 114. In an embodiment, a PCVT 200 may be transitionable from a first configuration to a second configuration and from the second configuration to a third configuration.

Figure 2:
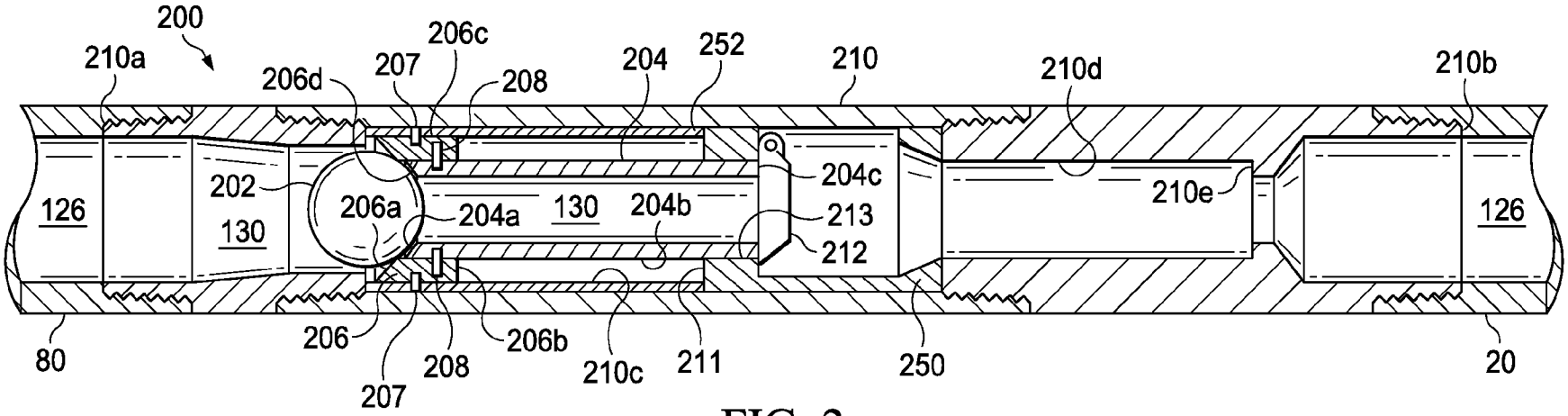
FIG. 2 is a cutaway view of an embodiment of a pressure control valve tool in a first configuration.

Referring to FIG. 2, an embodiment of a PCVT 200 is illustrated in the first configuration. In an embodiment, when the PCVT 200 is in the first configuration, also referred to as a run-in or installation position, the PCVT 200 may be configured so as to allow for fluid communication therethrough in a first direction (e.g., downward fluid communication) and to not allow fluid communication therethrough in a second direction (e.g., upward fluid communication), as is described herein. In an embodiment, as is disclosed herein, the PCVT 200 may be configured to transition from the first configuration to the second configuration upon the introduction of a first obturating member to the flowbore of the PCVT 200 and the application of a pressure of at least a threshold pressure to the first obturating member and/or the flowbore of the PCVT 200, as will be disclosed herein. For example, the PCVT 200 may be configured to transition from the first configuration to the second configuration upon experiencing an application of a threshold pressure onto the first obturating member. In such an embodiment, the threshold pressure may be at least about 500 psi, alternatively, about 750 psi, alternatively, about 1,000 psi, alternatively, about 1,500 psi, alternatively, about 2,000 psi, alternatively, about 2,500 psi, alternatively, about 3,000 psi, alternatively, about 4,000 psi, alternatively, about 5,000 psi, alternatively, about 6,000 psi, alternatively, about 7,000 psi, alternatively, about 8,000 psi, alternatively, about 10,000 psi, alternatively, alternatively, about 12,000 psi, alternatively, about 14,000 psi, alternatively, about 16,000 psi, alternatively, about 18,000 psi, alternatively, about 20,000 psi, alternatively, any suitable pressure. As will be appreciated by one of skill in the art upon viewing this disclosure, the threshold pressure may depend upon various factors, for example, including, but not limited to, the type of wellbore servicing operation being implemented.

Figure 5:
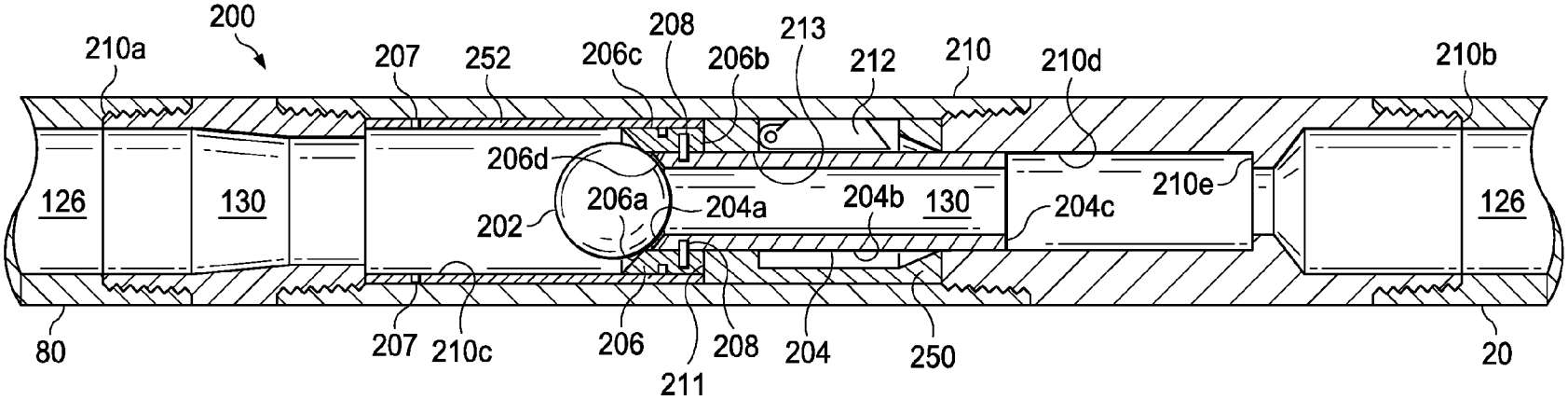
FIG. 5 is a cutaway view of an embodiment of a pressure control valve tool in a second configuration comprising a first obturating member.

Referring to FIG. 5, an embodiment of the PCVT 200 is illustrated in the second configuration. In an embodiment, when the PCVT 200 is in the second configuration, the PCVT 200 may be configured so as to allow for fluid communication therethrough in both the first direction (e.g., downward fluid communication) and in the second direction (e.g., upward fluid communication), as will be described herein. In an embodiment, the PCVT 200 may be configured so as to be retained in the second configuration (e.g., via a snap ring, a ratchet, etc.), as will be disclosed herein. In an embodiment, as will also be disclosed herein, the PCVT 200 may be configured to transition from the second configuration to the third configuration upon introducing a second obturating member and applying a pressure of at least a threshold pressure to the second obturating member and/or the flowbore of the PCVT 200. For example, the PCVT 200 may be configured to transition from the second configuration to the third configuration by applying a pressure to the PCVT 200 of at least about 500 psi, alternatively, about 750 psi, alternatively, about 1,000 psi, alternatively, about 1,500 psi, alternatively, about 2,000 psi, alternatively, about 2,500 psi, alternatively, about 3,000 psi, alternatively, about 4,000 psi, alternatively, about 5,000 psi, alternatively, about 6,000 psi, alternatively, about 7,000 psi, alternatively, about 8,000 psi, alternatively, about 10,000 psi, alternatively, alternatively, about 12,000 psi, alternatively, about 14,000 psi, alternatively, about 16,000 psi, alternatively, about 18,000 psi, alternatively, about 20,000 psi, alternatively, any suitable pressure. As will be appreciated by one of skill in the art upon viewing this disclosure, the threshold pressure may depend upon various factors, for example, including, but not limited to, the type of wellbore servicing operation being implemented.

Figure 8:
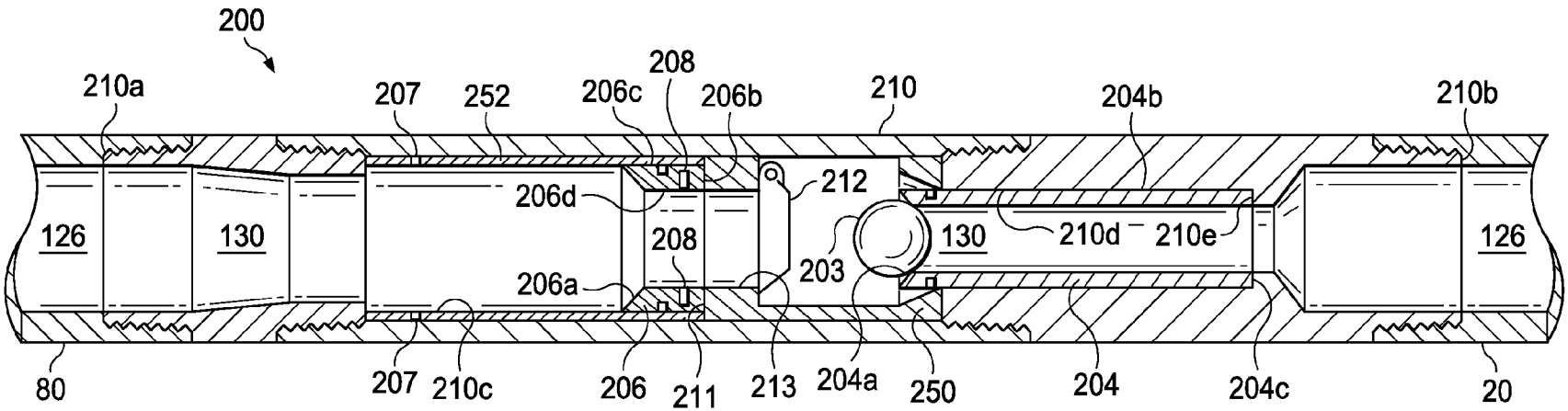
FIG. 8 is a cutaway of an embodiment of a pressure control valve tool in a third configuration.

Referring to FIG. 8, an embodiment of the PCVT 200 is illustrated in third configuration. In an embodiment, when the PCVT 200 is in the third configuration, also referred to as the pull-out position, the PCVT 200 may be configured so as to allow for fluid communication therethrough in a first direction (e.g., downward fluid communication) and to not allow fluid communication therethrough in a second direction (e.g., upward fluid communication), as will be described herein. In an embodiment, the PCVT 200 may be configured to remain in the third configuration upon transitioning to the third configuration.

Referring to FIGS. 2-8, in an embodiment the PCVT 200 generally comprises a housing 210, a first sleeve 206, a second sleeve 204, and a valve 212. Additionally, the PCVT 200 may also be characterized as at least a partial continuation of the flowbore 126 of the work string 112. While an embodiment of the PCVT 200 is disclosed with respect to FIGS. 2-8, one of skill in the art upon viewing this disclosure, will recognize suitable alternative configurations. As such, while embodiments of a PCVT may be disclosed with reference to a given configuration (e.g., PCVT 200 as will be disclosed with respect to FIGS. 2-8), this disclosure should not be construed as limited to such embodiments.

In an embodiment, the housing 210 may be characterized as a generally tubular body having a first terminal end 210*a* (e.g., an up-hole end) and a second terminal end 210*b* (e.g., a down-hole end), for example as illustrated in FIG. 2. The housing 210 may also be characterized as generally defining a longitudinal, axial flowbore 130. In an embodiment, the housing 210 may be configured for connection to and/or incorporation within a string, such as the work string 112. For example, the housing 210 may comprise a suitable means of connection to the work string 112 (such as the jointed tubing 20 and/or the coiled tubing 80 as illustrated in FIGS. 2-8). For instance, in an embodiment the first terminal end 210*a* of the housing 210 may comprise internally and/or externally threaded surfaces as may be suitably employed in making a threaded connection to the work string 112 (e.g., to a coiled tubing segment, such as coiled tubing segment 80, for example, via a coiled tubing adapter). In an additional or alternative embodiment, the second terminal end 210*b* of the housing 210 may also comprise internally and/or externally threaded surfaces as may be suitably employed in making a threaded connection to the work string 112 (e.g., to a segment of jointed tubing 20). Alternatively, a PCVT like PCVT 200 may be incorporated within a work string like work string 112 by any suitable connection, such as, for example, via one or more quick-connector type connections. Suitable connections to a work string member will be known to those of skill in the art viewing this disclosure. In an embodiment, the PCVT 200 may be integrated and/or incorporated with the work string 112 such that the axial flowbore 130 may be in fluid communication with the axial flowbore 126 defined by work string 112, for example, such that a fluid communicated via the axial flowbore 126 of the work string 112 will flow into and through the axial flowbore 130 of the PCVT 200.

In an embodiment, the housing 210 may be configured to allow one or more sleeves (e.g., the first sleeve 206 and the second sleeve 204) to be slidably positioned therein. For example, in an embodiment, the housing may generally comprise a first cylindrical bore surface 210*c* and a second cylindrical bore surface 210*d*. In an embodiment, the first cylindrical bore surface 210*c* may generally define an upper interior portion of the housing 210, for example, extending from the first terminal end 210*a* (e.g., an uphole end) of the housing 210. Additionally, in an embodiment, the second cylindrical bore surface 210*d* may generally define an interior portion of the housing 210 below the first cylindrical bore surface 210*c*. In an embodiment, the first cylindrical bore surface 210*c* may be generally characterized as having a diameter greater than the diameter of the second cylindrical bore surface 210*d*.

Additionally, in an embodiment, the housing 210 may further comprise a lower contact surface 210*e*, for example, circumferential shoulder, protrusion, or lug. In an embodiment, the lower contact surface 210*e* may be disposed along a lower interior portion of the housing 210. In such an embodiment, the lower contact surface 210*e* may be configured to restrict and/or substantially restrict the motion of one or more sleeves in the direction of the second terminal end 210*b* (e.g., a lower end), as will be disclosed herein.

In an embodiment, the valve 212 may be generally configured, when activated, as will be disclosed herein, to close and/or seal the axial flowbore 130 of the PCVT 200 to fluid communication thereby prohibiting fluid communication in one direction (e.g., upward fluid communication) and allowing fluid communication in the opposite direction (e.g., downward fluid communication). In an embodiment, the valve 212 may be characterized as one-way or unidirectional valve, that is, configured to allow fluid communication therethrough in only a single direction (e.g., when activated). For example, in an embodiment, the valve 212 may comprise a flapper valve. In such an embodiment, each of the activatable flapper valves may comprise a flap or disk movably (e.g., rotatably) secured within the housing 210 (e.g., directly or indirectly) via a hinge. In an embodiment, the flapper may be hinged to the housing 210, alternatively, to a body which may be disposed within the housing 210. For example, in the embodiments of FIGS. 2-8, the flapper 212 is hinged to a body 250 disposed within the interior of the housing 210 and comprises one or more contact surfaces (e.g., a sliding surface 213 and an upper contact surface 211), for example, for the purpose of engaging one or more sleeves (e.g., the first sleeve 206 and the second sleeve 204), as will be disclosed herein. Optionally, in the embodiment where the flapper is hinged to a body 250 disposed within the housing 210, the body 250 may be retained in a longitudinal position within the housing 210 via one or more positioning members (e.g., one or more spacers 252).

In an embodiment, the flapper may be rotatable about the hinge from a first, closed position in which the flapper extends across the axial flowbore 130 to a second, open position in which the flapper does not extend across the axial flowbore 130. In an embodiment, the flapper may be biased, for example, biased toward the first, closed position via the operation of any suitable biasing means or member, such as a spring-loaded hinge. In an embodiment, when the flapper is in the second position, the flapper may be retained within a recess within the longitudinal bore of the housing 210, such as a depression (alternatively, a groove, cut-out, chamber, hollow, or the like). Also, when the flapper is in the first position, the flapper may protrude into the axial flowbore 130, for example, so as to sealingly engage or rest against a seat or sealing surface of the body 250 and/or a portion of the housing 210 (for example, so as to engage a shoulder, a mating seat, the like, or combinations thereof). The flapper may be round, elliptical, or any other suitable shape.

In an embodiment, as will be disclosed herein, the valve 212 may be activated and/or inactivated through an interaction with the movement of one or more sleeves (e.g., the first sleeve 206 and the second sleeve 204). As used herein, reference to the valve 212 as being in an "activated" state may mean that the valve 212 is free to move between the first, closed position and the second, open position. Also, as used herein, reference to the valve 212 as being in an "inactivated" state may mean that the valve 212 is not free to move between the first, closed position and the second, open position.

In the embodiments illustrated in FIGS. 2 and 4-8, the PCVT may comprise a single valve. In an embodiment as illustrated in FIG. 3, the PCVT 200 may comprise two valves (e.g., a first valve 212*a* and a second valve 212*b*), in alternative embodiments, an PCVT may similarly comprise three valves, alternatively, four valves, alternatively, any suitable number of valves.

Figure 4:
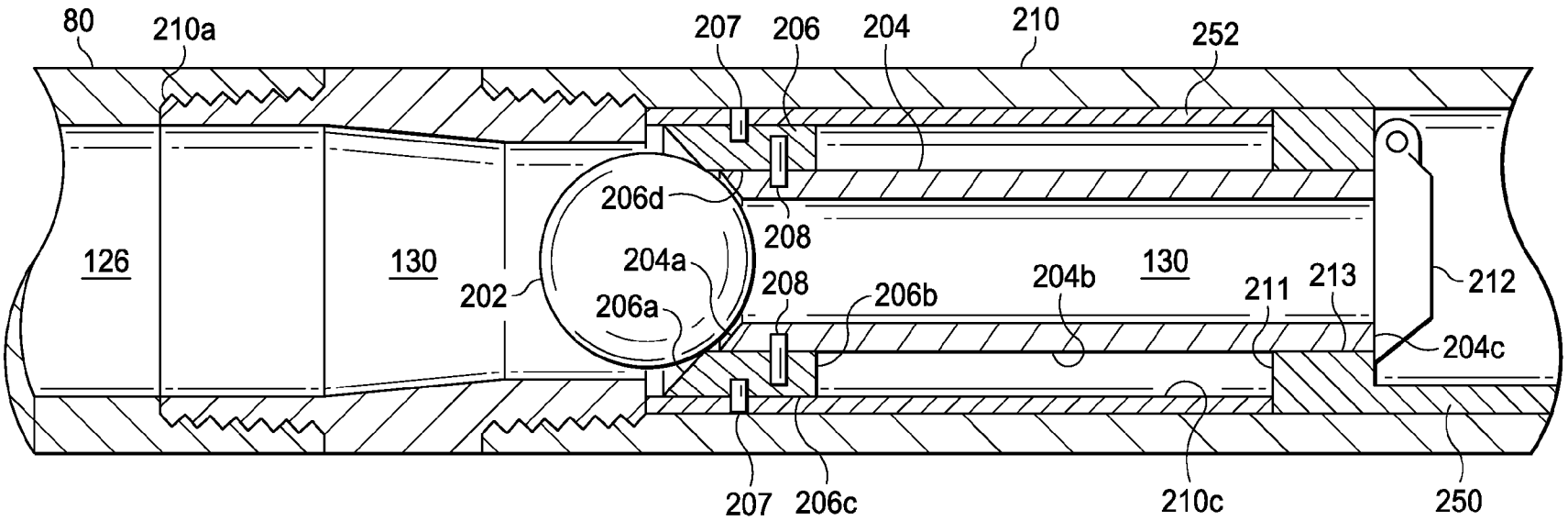
FIG. 4 is a partial cutaway view of an embodiment of a pressure control valve tool in a first configuration.

In an embodiment, the first sleeve 206 and/or the second sleeve 204 may generally comprise concentric cylindrical or tubular structures. Referring to FIG. 4, in an embodiment, the first sleeve 206 may comprise a first contact surface 206*a*, a second contact surface 206*b*, an outer cylindrical surface 206*c*, and an inner bore surface 206*d*. In such an embodiment, the first sleeve 206 may be positioned such that the outer cylindrical surface 206*c* is slidably fitted against at least a portion of an interior bore surface (e.g., the first cylindrical bore surface 210*c*) of the housing 210 in a fluid-tight or substantially fluid-tight manner. Additionally, the first sleeve 206 may further comprise one more suitable seals (e.g., an O-ring, a T-seal, a snap ring, a gasket, etc.) disposed along the outer cylindrical surface 206*c* of the first sleeve 206, for example, for the purpose of prohibiting and/or restricting fluid movement via such an interface. In an embodiment, the second sleeve 204 may comprise a first contact surface 204*a*, a second contact surface 204*c*, and an outer cylindrical surface 204*b*. In an embodiment, the diameter of the outer cylindrical surface 204*b* may be less than the diameter of the of the inner bore surface 206*d* of the first sleeve 206, the second cylindrical bore surface 210*d* of the housing 210, and the sliding surface 213 of the flapper, if present. Additionally, the second sleeve 204 may further comprise one more suitable seals (e.g., an O-ring, a T-seal, a snap ring, a gasket, etc.) disposed along the outer cylindrical surface 204*b* of the second sleeve 204, for example, for the purpose of prohibiting and/or restricting fluid movement via such an interface.

Referring to the embodiments of FIGS. 2-8, the first sleeve 206 and/or the second sleeve 204 may each be slidably positioned within the housing 210. For example, the first sleeve 206 and the second sleeve 204 may each be slidably movable between various longitudinal positions with respect to the housing 210 and/or with respect to each other. Additionally, the relative longitudinal position of the first sleeve 206 and/or the second sleeve 204 may determine if the one or more valves are in the first position or the second position and/or in an activated state or an inactivated state.

Figure 3:
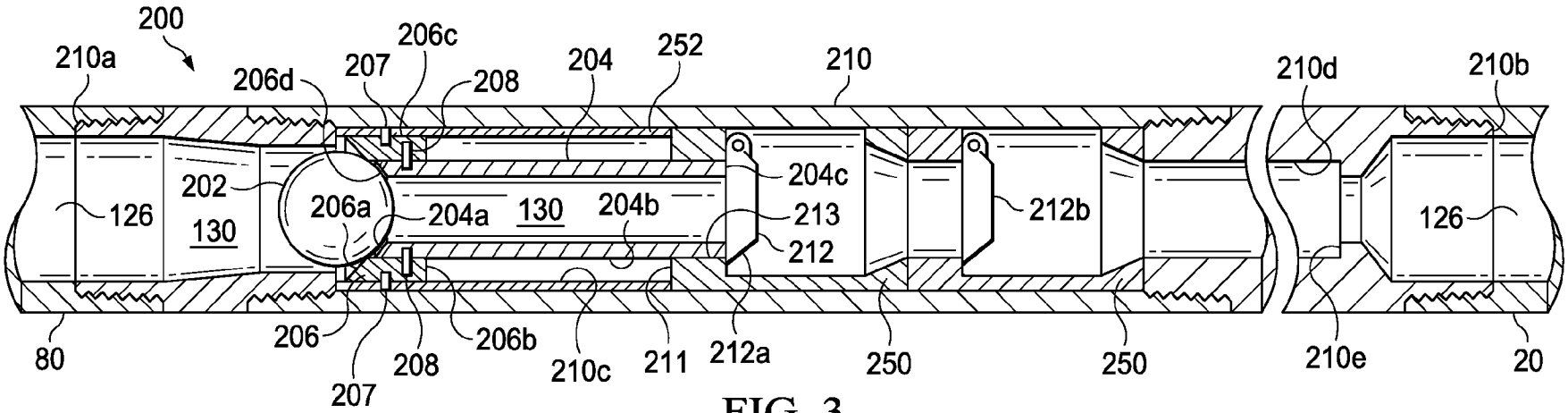
FIG. 3 is a cutaway view of another embodiment of a pressure control valve tool in a first configuration.

Referring to the embodiment of FIGS. 2-4, when the PCVT 200 is configured in the first configuration, the first sleeve 206 is in a first position with respect to the housing 210. In such an embodiment, the first sleeve 206 may be coupled to the housing 210, for example, via a shear pin, a snap ring, etc., for example, such that the first sleeve 206 is fixed relative to the housing 210. For example, in the embodiments of FIGS. 2-4, the first sleeve 206 is coupled to the housing 210 via a shear pin 207. Additionally, in such an embodiment, the second sleeve 204 may be in a first position with respect to the first sleeve 206, wherein at least a portion of the outer cylindrical surface 204*b* of the second sleeve 204 may be slidably fitted against the inner bore surface 206*d* of the first sleeve 206 and may be coupled to the first sleeve 206, for example, via a shear pin, a snap ring, etc., for example, such that the second sleeve 204 is fixed relative to the first sleeve 206. For example, in the embodiments of FIGS. 2-4, the second sleeve 204 is coupled to the first sleeve 206 via a shear pin 208. Additionally, in such an embodiment, the second sleeve 204 may be configured and/or positioned such that the first contact surface 204*a* of the second sleeve 204 is offset from the first contact surface 206*a* of the first sleeve 206 away from the first terminal end 210*a* (e.g., up-hole end) of the housing 210. For example as illustrated in FIG. 4, the first sleeve 206 and the second sleeve 204 may be positioned such that an obturating member 202 may engage the first sleeve 206 and not the second sleeve 204. In an embodiment, the second sleeve 204 may be configured to selectively engage the flapper 212 (e.g., via the second contact surface 204*c*). Additionally, in such an embodiment, the valve 212 may be configured to be in the first position (e.g., a closed position) and/or in an activated state, thereby prohibiting fluid communication in one direction (e.g., upward fluid communication) and allowing fluid communication in the opposite direction (e.g., downward fluid communication). For example, a fluid may be communicated in the downward direction (e.g., from the surface to down-hole) and may not be communicated in the upward direction (e.g., from down-hole to the surface).

Figure 6:
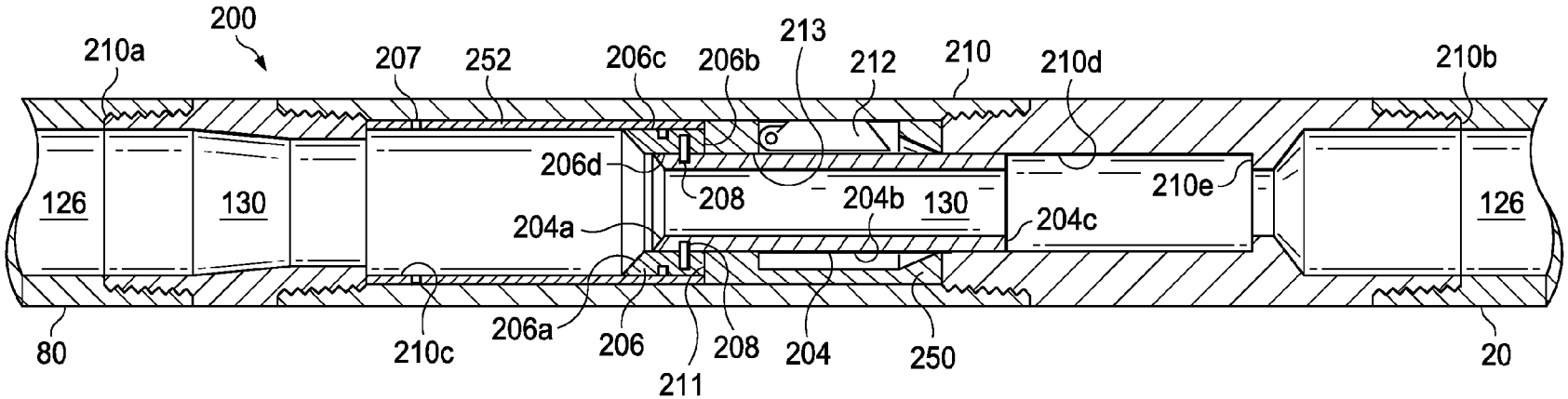
FIG. 6 is a cutaway view of an embodiment of a pressure control valve tool in a second configuration.
Figure 7:
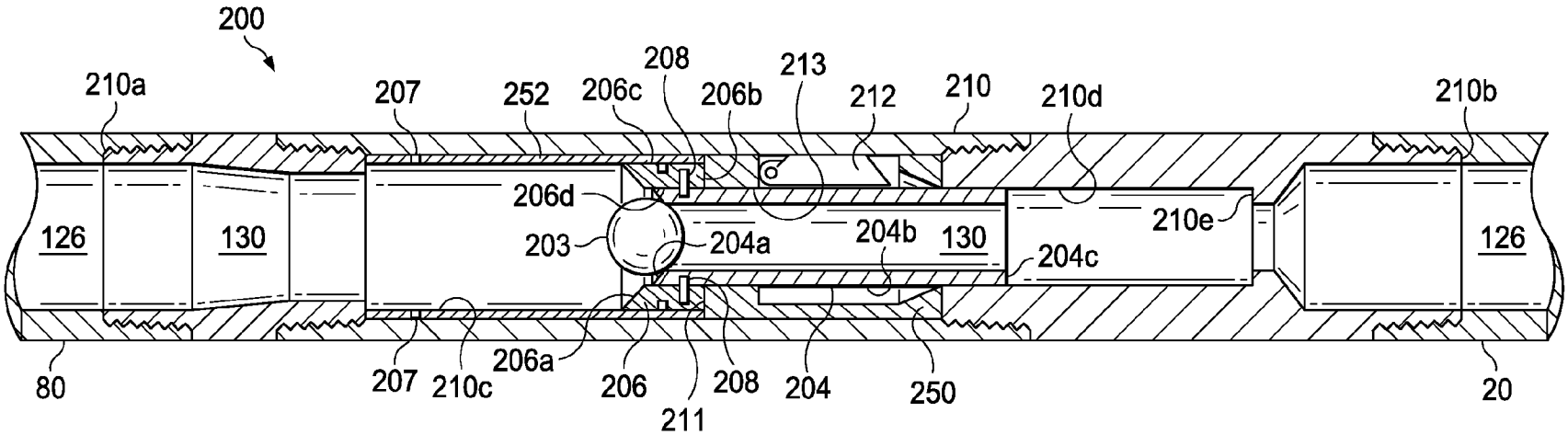
FIG. 7 is a cutaway view of an embodiment of a pressure control valve tool in a second configuration comprising a second obturating member.

Referring to the embodiment of FIGS. 5-7, when the PCVT 200 is configured in the second configuration, the first sleeve 206 is in a second position with respect to the housing 210 and the second sleeve 204 is in the first position with respect to the first sleeve 206 (e.g., the second sleeve 204 remains fixed to the first sleeve 206). In an embodiment, when the first sleeve 206 is in the second position, the first sleeve 206 may be configured to engage the upper contact surface 211 of the housing of the flapper 212 and, thereby restricting and/or substantially restricting the first sleeve 206 from moving longitudinally in the direction of the second terminal end 210*b* (e.g., a lower end). In an embodiment, when the first sleeve 206 is in the second position, the second sleeve 204 maintains the flapper 212 within a recess within the longitudinal bore of the housing 210, such as a depression (alternatively, a groove, cut-out, chamber, hollow, or the like), which may be provided by the valve body 250. Additionally, in such an embodiment, the valve 212 may be configured to be in the second position (e.g., an open position) and/or in an inactivated state, thereby allowing bidirectional fluid communication via the axial flowbore 130 of the PCVT 200. In an embodiment, the first sleeve 206 may be retained in the second position with respect to the housing 210, for example, via a snap ring 209, alternatively, a ratchet mechanism or a biased pin.

Referring to the embodiment of FIG. 8, when the PCVT 200 is configured in the third configuration, the first sleeve 206 is in the second position with respect to the housing 210 and the second sleeve 204 is in a second position with respect to the first sliding sleeve 206. In an embodiment, when the second sleeve 204 is in the second position, the second sleeve 204 may no longer be coupled to the first sleeve 206. Also, in the second position, the second sleeve 204 does not (i.e., no longer) retains the flapper 212 within the recessed chamber of the housing 210. Additionally, when the second sleeve 204 is in the second position, the second sleeve 204 may be configured to engage the lower contact surface 210*e* of the housing 210 and, thereby restricting and/or substantially restricting from the second sleeve 204 moving longitudinally in the direction of the second terminal end 210*b* (e.g., a lower end). Additionally, in such an embodiment, the valve 212 may be configured to be in the first position (e.g., a closed position) and/or in an activated state, for example, a fluid may be communicated in the downward direction (e.g., from the surface to down-hole) and may not be communicated in the upward direction (e.g., from down-hole to the surface).

In an embodiment, the first sleeve 206 and the second sleeve 204 may each be configured so as to be selectively moved downwardly (e.g., toward the second terminal end 210*b*). For example, in an embodiment, the first sleeve 206 and the second sleeve 204 may each be configured such that when engaged by an obturating member the application of a fluid and/or hydraulic pressure (e.g., a hydraulic pressure exceeding a threshold pressure) to the axial flowbore 130 and onto the obturating member will cause the first sleeve 206 and/or the second sleeve 204 to move in the downward direction (e.g., toward the second terminal end 210*b*). For example, in such an embodiment, PCVT 200 may be configured such that following the engagement of an obturating member by the PCVT 200 (e.g., the first sleeve or the second sleeve), an application of fluid pressure of at least the threshold pressure to the axial flowbore 130 (e.g., via, the flowbore 126) results in a net hydraulic force applied to the first sleeve 206 and/or the second sleeve 204 (e.g., via the obturating member) in the axially downward direction (e.g., in the direction towards the second terminal end 210*b*). In such an embodiment, the force applied to the first sleeve 206 and/or the second sleeve 204 as a result of the application of such a fluid or hydraulic pressure to the PCVT 200 may be greater in the axial direction toward the second terminal end 210*b* (e.g., downward forces) than the sum of any forces applied in the opposite axial direction, for example, in the axial direction toward the first terminal end 210*a* (e.g., upward forces).

For example, in the embodiment of FIG. 2, the first sleeve 206 may be configured to engage a first obturating member 202, for example, via the first contact surface 206*a*. In such an embodiment, the introduction of the first obturating member 202 may configure the PCVT 200 such that a hydraulic pressure applied to the axial flowbore 126 will apply a downward force to the first sleeve 206. Additionally, in such an embodiment, the PCVT 200 may be configured such that the application of a fluid or hydraulic pressure (e.g., a fluid or hydraulic pressure exceeding a threshold pressure) to the axial flowbore 130 onto the first obturating member 202 will cause the first sleeve 206 to move from the first position to the second position with respect to the housing 210.

Additionally, in the embodiment of FIG. 7, the second sleeve 204 may be configured to engage a second obturating member 203, for example, via the first contact surface 204*a*. In such an embodiment, the introduction of the second obturating member 203 may configure the PCVT 200 such that a hydraulic pressure applied to the axial flowbore 126 will apply a downward force to the second sleeve 206. Additionally, in such an embodiment, the PCVT 200 may be configured such that the application of a fluid or hydraulic pressure (e.g., a fluid or hydraulic pressure exceeding a threshold pressure) to the axial flowbore 130 onto the second obturating member 203 will cause the second sleeve 204 to move from the first position to the second position with respect to the first sleeve 206.

While one or more of the embodiments disclosed herein may refer to the movement of one or more sleeves as a result of the application of a given fluid pressure, it is contemplated that a given PCVT may be configured for movement via any other suitable method, apparatus, or system, as would be appreciated by one of ordinary skill in the art upon viewing this disclosure.

One or more of embodiments of a PCVT (e.g., such as PCVT 200) and/or a wellbore servicing system (e.g., such as wellbore servicing system 100) comprising such a PCVT 200 having been disclosed, one or more embodiments of a wellbore servicing method employing such a wellbore servicing system 100 and/or such a PCVT 200 are also disclosed herein. In an embodiment, a wellbore servicing method may generally comprise the steps of positioning a work string (e.g., such as work string 112) having a PCVT 200 incorporated therein within a wellbore (such as wellbore 114), actuating the PCVT 200 for bidirectional fluid communications through the work string 112, further actuating the PCVT 200 for unidirectional fluid communications through the work string 112, and removing the PCVT 200 and/or the work string 112.

As will be disclosed herein, the PCVT 200 may control fluid movement through the work string 112 during the wellbore servicing method. For example, as will be disclosed herein, during the step of positioning the work string 112 within the wellbore 114, the PCVT 200 may be configured to prohibit fluid communication out of the wellbore 114 through the work string 112 (e.g., prohibiting upward fluid communication through the work string 112). Also, for example, via the step of actuating the PCVT 200 for bidirectional fluid communicating through the work string 112, the PCVT 200 may be configured to allow fluid communication through the work string 112 in both directions (e.g., upward and downward fluid communication), as will disclosed herein. Also, for example, during the step of actuating the PCVT 200 for unidirectional fluid communications through the work string 112, the PCVT 200 may be configured to prohibit fluid communication out of the wellbore 114 through the work string 112 (e.g., prohibiting upward fluid communication through the work string 112), thereby disallowing fluid communication through the work string 112 in both directions, as will be disclosed herein.

In an embodiment, positioning the work string 112 comprising the PCVT 200 may comprise forming and/or assembling the components of the work string 112, for example, as the work string 112 is run into the wellbore 114. For example, referring to the embodiment of FIG. 1 where the work string 112 comprises a jointed tubing string 80 located down-hole from the PCVT 200, the jointed tubing segments may be assembled as the jointed tubing is run-in. In some embodiments as disclosed herein, a wellbore servicing tool (such as wellbore servicing tool 150) may be incorporated within the jointed tubing string, for example, down-hole relative to the PCVT 200. In the embodiment of FIG. 1, the PCVT 200 is incorporated within the work string 112 atop the jointed tubing string 80. Referring again to the embodiment of FIG. 1, the coiled tubing may be attached atop the PCVT 200, for example, via a suitable coiled tubing adaptor as would be appreciated by one of ordinary skill in the art upon viewing this disclosure.

In an embodiment, the work string 112 may be run into the wellbore 114 with the PCVT 200 configured in the first configuration, for example, with the first sleeve 206 in the first position with respect to the housing 210 and the second sleeve 204 in the first position with respect to the first sleeve 206 as disclosed herein and as illustrated in the embodiment of FIG. 2 (in the absence of a first obturating member 202). In such an embodiment, with the PCVT 200 configured in the first configuration, the PCVT 200 will not allow upward fluid communication therethrough (and, as such, will not allow upward fluid communication through the work string 112) but will allow downward fluid communication therethrough (and, as such, will allow downward fluid communication through the work string 112). For example, as shown in the embodiment of FIG. 2, when the PCVT 200 is configured in the first configuration the one or more flapper valves 212 may be activated, that is, free to move into the first, closed position.

In an embodiment, the work string 112 may be run into the wellbore 114 to a desired depth. For example, the work string 112 may be run in such that the wellbore servicing tool 150 is positioned proximate to one or more desired subterranean formation zones to be treated (e.g., a first formation zone).

In an embodiment, actuating the PCVT 200 for bidirectional fluid communicating through the work string 112 may comprise transitioning the PCVT 200 from the first configuration to the second configuration, for example, via transitioning the first sleeve 206 from the first position to the second position with respect to the housing 210. In an embodiment, a first obturating member 202 may be introduced the axial flowbore 130 of the PCVT 200 (e.g., via the axial flowbore 126 of the work string 112) and may be pumped down-hole to engage the first sleeve 206 (e.g., via the first contact surface 206*a*). Additionally, in such an embodiment, the first obturating member 202 may not engage the first contact surface 204*a* of the second sleeve 204. In an embodiment, a fluid or hydraulic pressure may be applied to the axial flowbore 130 of the PCVT 200 (e.g., via the axial flowbore 126 of the work string 112) and onto the first obturating member 202. For example, in an embodiment, a fluid may be pumped into the axial flowbore 126 of the work string 112, for example, via one or more pumps generally located at the earth's surface 104.

In an embodiment, the application of such a fluid or hydraulic pressure may be effective to transition the first sleeve 206 from the first position to the second position with respect to the housing 210. As disclosed herein, the application of fluid or hydraulic pressure to the PCVT 200 may yield a force in the direction of the second position. For example, in an embodiment, the fluid or hydraulic pressure may be of a magnitude sufficient to exert a force to shear one or more shear pins 207, thereby causing the first sleeve 206 to move relative to the housing 210 and transitioning the first sleeve 206 from the first position to the second position with respect to the housing 210. In an embodiment, as illustrated in FIG. 5, the first sleeve 206 may continue to move in the direction of the second position until the second contact surface 206*b* of the first sleeve 206 contacts and/or abuts the upper contact surface 211 of the valve housing, thereby prohibiting the first sleeve 206 from continuing to slide. In an additional or alternative embodiment, the first sleeve 206 may comprise one or more snap rings, alternatively, ratchet teeth, disposed onto the outer cylindrical surface 206*c* of the first sleeve 206 which may engage with a groove or slot on one or more interior surfaces of the housing 210 (e.g., the first cylindrical bore surface 210*c*), thereby prohibiting the first sleeve 206 from continuing to slide.

Additionally, in an embodiment following the transition of the PCVT 200 from the first configuration to the second configuration, the first obturating member 202 may be removed from the PCVT 200 and/or the work string 112. For example, in an embodiment, a suction force may be applied to the axial flowbore 126 of the work string 112 and/or the axial flowbore 130 of the PCVT 200 (e.g., via a suction tool at the earth's surface 104), thereby moving (e.g., pulling via reverse flow) the first obturating member 202 in an uphole direction (e.g., towards the earth's surface 104) and extracting the first obturating member 202 from the PCVT 200. For example, in an embodiment the first obturating member 202 may be flowed back to the surface via a differential pressure between the subterranean formation 102 and earth's surface 104. In an embodiment as illustrated in FIG. 6, following the removal of the first obturating member 202, the PCVT 200 may be configured in the second configuration and may allow bidirectional fluid communication (e.g., between the earth's surface 104 and the formation 102 via the work string 112) via the PCVT 200.

In an embodiment, actuating the PCVT 200 for unidirectional flow may comprise transitioning the PCVT 200 from the second configuration to the third configuration, for example, via transitioning the second sleeve 204 from the first position to the second position with respect to the first sleeve 206. In an embodiment as shown in FIG. 7, a second obturating member 203 may be introduced the axial flowbore 130 of the PCVT 200 (e.g., via the axial flowbore 126 of the work string 112). In such an embodiment, the second obturating member 203 may comprise a smaller diameter than the inner bore surface 206*d* of the first sleeve 206. In an embodiment, the second obturating member 203 may engage the second sleeve 204 (e.g., via the first contact surface 204*a*) and not the first contact surface 206*a* of the first sleeve 206. Additionally, in an embodiment, a fluid or hydraulic pressure may be applied to the axial flowbore 130 of the PCVT 200 (e.g., via the axial flowbore 126 of the work string 112) and onto the second obturating member 203. For example, in an embodiment, a fluid may be pumped into the axial flowbore 126 of the work string 112, for example, via one or more pumps generally located at the earth's surface 104.

In an embodiment, the application of such a fluid or hydraulic pressure may be effective to transition the second sleeve 204 from the first position to the second position with respect to the first sleeve 206. As disclosed herein, the application of fluid or hydraulic pressure to the PCVT 200 may yield a force in the direction of the second position. For example, in an embodiment, the fluid or hydraulic pressure may be of a magnitude sufficient to exert a force to shear one or more shear pins 208, thereby causing the second sleeve 204 to move relative to the first sleeve 204 and/or housing 210 and transitioning the second sleeve 204 from the first position to the second position with respect to the first sleeve 206. In an embodiment, as illustrated in FIG. 8, the second sleeve 204 may continue to move in the direction of the second position until the second contact surface 204*c* of the second sleeve 204 contacts and/or abuts the lower contact surface 210*e* of the housing 210, thereby prohibiting the second sleeve 204 from continuing to slide. In an additional or alternative embodiment, the second sleeve 204 may comprise one or more snap rings or ratchet teeth disposed onto the outer cylindrical surface 204*b* of the second sleeve 204 which may engage with a groove or slot on one or more interior surfaces of the housing 210 (e.g., the second cylindrical bore surface 210*d*), thereby prohibiting the second sleeve 204 from continuing to slide.

In the embodiment of FIG. 8, the PCVT 200 is configured in the third configuration, a pull-out position, and thereby disallows bidirectional fluid communication (e.g., between the earth's surface 104 and the formation 102 via the work string 112) via the PCVT 200.

In an embodiment, and as similarly disclosed herein, the work string 112 may be removed from the wellbore 114 while the PCVT 200 is configured in the third configuration, for example, with the first sleeve 206 in the second position with respect to the housing 210 and the second sleeve 204 in the second position with respect to the first sleeve 206 as disclosed herein and as shown in FIG. 8. As disclosed herein, in such an embodiment, with the PCVT 200 configured in the third configuration, the PCVT 200 will not allow upward fluid communication therethrough (and, as such, will not allow upward fluid communication through the work string 112) but will allow downward fluid communication therethrough (and, as such, will allow downward fluid communication through the work string 112).

Additionally, in an embodiment, the PCVT 200 may be removed from the work string 112 and serviced or reconfigured to the first configuration. For example, in an embodiment, during a work string break down method the PCVT 200 may be removed from the work string 112 (e.g., the coiled tubing 80 and/or jointed tubing 20), the second obturating member 203 may be removed from the PCVT 200, and the first sleeve 206 and the second sleeve 204 may be each reconfigured to their first position, thereby reconfiguring the PCVT 200 to the first configuration for future wellbore servicing operations.

In an embodiment, a PCVT (like PCVT 200), a system utilizing a PCVT, and/or a method utilizing such a PCVT and/or system a system may be advantageously employed in the performance of a wellbore servicing operation. For example, as disclosed herein, the PCVT allows for an operator to selectively block fluid communication upwardly through a work string (or other tubular, wellbore string). As such, a PCVT may be employed to improve safety in a wellbore/well site environment, for example, by providing a means of controlling the unintended escape of fluids or pressures from a wellbore (e.g., when the PCVT is so-configured, as disclosed herein). Additionally, a PCVT may provide the ability to allow or disallow bidirectional fluid communication via the PCVT (e.g., via toggling one or more valves from an activated state to/from an inactivated state) without the use of wire line tools and/or plugs. As such, the PCVT may be efficiently transitioned between various configurations, as disclosed herein, via the application of a threshold of pressure applied onto an obturating member disposed within the PCVT.

ADDITIONAL DISCLOSURE

The following are nonlimiting, specific embodiments in accordance with the present disclosure:

A first embodiment, which is a wellbore servicing system comprising:

a work string; and a pressure control valve tool incorporated within the work string and comprising:

a housing generally defining an axial flowbore;

a flapper valve disposed within the axial flowbore and configurable between an activated state and an inactivated state;

wherein, in the activated state the flapper valve is free to move between a closed position in which the flapper valve blocks the axial flowbore and an open position in which the flapper valve does not block the axial flowbore; and wherein, in the inactivated state the flapper valve is retained in the open position;

a first sleeve slidably positioned within the housing and transitional from a first position to a second position with respect to the housing; and a second sleeve slidably positioned within the first sleeve and transitional from a first position to a second position with respect to the first sleeve;

wherein, when the first sleeve is in the first position with respect to the housing and the second sleeve is in the first position with respect to the first sleeve, the flapper valve is in the activated state;

wherein, when the first sleeve is in the second position with respect to the housing and the second sleeve is in the first position with respect to the first sleeve, the flapper valve is in the inactivated state;

wherein, when the first sleeve is in the second position with respect to the housing and the second sleeve is in the second position with respect to the first sleeve, the flapper valve is in the activated state; and wherein, engagement of a first obturating member with the first sleeve and the application of a pressure of at least a threshold pressure onto the first obturating member causes the first sleeve to transition from the first position to the second position with respect to the housing and such that the engagement of a second obturating member with the second sleeve and the application of a pressure of at least a threshold pressure onto the second obturating member causes the second sleeve to transition from the first position to the second position with respect to the first sleeve.

A second embodiment, which is the wellbore servicing system of the first embodiment, wherein when the first sleeve is in the first position, the first sleeve is releasably coupled to the housing via a first retaining device comprising a shear pin, a snap ring, a biased pin, or combinations thereof.

A third embodiment, which is the wellbore servicing system of the second embodiment, wherein when the first sleeve is in the second position, the first sleeve is coupled to the housing via a snap ring.

A fourth embodiment, which is the wellbore servicing system of on of the first through the third embodiments, wherein when the second sleeve is in the first position, the second sleeve is releasably coupled to the first sleeve via a second retaining device comprising a shear pin, a snap ring, a biased pin, or combinations thereof.

A fifth embodiment, which is the wellbore servicing system of the fourth embodiment, wherein when the second sleeve is in the second position, the second sleeve is not coupled to the first sleeve.

A sixth embodiment, which is the wellbore servicing system of one of the first through the fifth embodiments, wherein the first obturating member may be sized to engage the first sleeve and not the second sleeve.

A seventh embodiment, which is the wellbore servicing system of the sixth embodiment, wherein the second obturating member may be sized to engage the second sleeve and not the first sleeve.

An eighth embodiment, which is the wellbore servicing system of one of the first through the seventh embodiments, wherein the pressure control valve tool comprises two or more flapper valves disposed within the axial flowbore and configurable between the activated state and the inactivated state.

A ninth embodiment, which is a wellbore servicing method comprising:

positioning a work string comprising a pressure control valve tool (PCVT) in a first configuration incorporated therein within a wellbore, wherein in the first configuration the PCVT provides unidirectional fluid flow through the work string;

introducing of a first obturating member within the PCVT and applying at least a pressure threshold onto the first obturating member thereby allowing bidirectional fluid communication through the work string;

introducing of a second obturating member within the PCVT and applying of at least a pressure threshold onto the second obturating member thereby allowing unidirectional fluid communication;

removing the working string comprising the PCVT from the wellbore.

A tenth embodiment, which is the wellbore servicing method of the ninth embodiment, wherein the PCVT further comprises:

a housing generally defining an axial flowbore;

a flapper valve disposed within the axial flowbore and configurable between an activated state and an inactivated state;

wherein, in the activated state the flapper valve is free to move between a closed position in which the flapper valve blocks the axial flowbore and an open position in which the flapper valve does not block the axial flowbore; and wherein, in the inactivated state the flapper valve is retained in the open position;

a first sleeve slidably positioned within the housing and transitional from a first position to a second position with respect to the housing; and a second sleeve slidably positioned within the first sleeve and transitional from a first position to a second position with respect to the first sleeve;

wherein, when the first sleeve is in the first position with respect to the housing and the second sleeve is in the first position with respect to the first sleeve, the flapper valve is in the activated state;

wherein, when the first sleeve is in the second position with respect to the housing and the second sleeve is in the first position with respect to the first sleeve, the flapper valve is in the inactivated state;

wherein, when the first sleeve is in the second position with respect to the housing and the second sleeve is in the second position with respect to the first sleeve, the flapper valve is in the activated state; and wherein, engagement of a first obturating member with the first sleeve and the application of a pressure of at least a threshold pressure onto the first obturating member causes the first sleeve to transition from the first position to the second position with respect to the housing and such that the engagement of a second obturating member with the second sleeve and the application of a pressure of at least a threshold pressure onto the second obturating member causes the second sleeve to transition from the first position to the second position with respect to the first sleeve.

An eleventh embodiment, which is the wellbore servicing method of the tenth embodiment, wherein when the first sleeve is in the first position, the first sleeve is releasably coupled to the housing via a first retaining device comprising a shear pin, a snap ring, a biased pin, or combinations thereof.

A twelfth embodiment, which is the wellbore servicing method of the eleventh embodiment, wherein when the first sleeve is in the second position, the first sleeve is coupled to the housing via a snap ring.

A thirteenth embodiment, which is the wellbore servicing method of one of the tenth through the eleventh embodiments, wherein when the second sleeve is in the first position, the second sleeve is releasably coupled to the first sleeve via second retaining device comprising a shear pin, a snap ring, a biased pin, or combinations thereof.

A fourteenth embodiment, which is the wellbore servicing method of the thirteenth embodiment, wherein when the second sleeve is in the second position, the second sleeve is not coupled to the first sleeve.

A fifteenth embodiment, which is the wellbore servicing method of the fourteenth embodiment, wherein the first obturating member may be sized to engage the first sleeve and not the second sleeve.

A sixteenth embodiment, which is the wellbore servicing method of the fifteenth embodiment, wherein the second obturating member may be sized to engage the second sleeve and not the first sleeve.

A seventeenth embodiment, which is the wellbore servicing method of one of the ninth through the sixteenth embodiments, wherein the pressure control valve tool comprises two or more flapper valves disposed within the axial flowbore and configurable between the activated state and the inactivated state.

An eighteenth embodiment, which is a wellbore servicing method comprising:

positioning a work string comprising a pressure control valve tool (PCVT) in a first configuration incorporated therein within a wellbore;

wherein, the PCVT is configurable from the first configuration to a second configuration and from the second configuration to a third configuration;

wherein, when the PCVT is in the first configuration, the PCVT is configured to allow a route of fluid communication in a down-hole direction and to disallow a route of fluid in an up-hole direction via the PCVT;

wherein, when the PCVT is in the second configuration, the PCVT is configured to allow bidirectional fluid communication via the PCVT; and wherein, when the PCVT is in the third configuration, the PCVT is configured to allow a route of fluid communication in a down-hole direction and to disallow a route of fluid in an up-hole direction via the PCVT;

transitioning the PCVT from the first configuration to the second configuration thereby allowing bidirectional fluid communication through the work string;

transitioning the PCVT from the second configuration to the third configuration thereby allowing unidirectional fluid communication; and removing the working string comprising the PCVT from the wellbore.

A nineteenth embodiment, which is the wellbore servicing method of the eighteenth embodiment, wherein the PCVT transitions from the first configuration to the second configuration upon the introduction of a first obturating member within the PCVT and the application of at least a pressure threshold onto the first obturating member.

A twentieth embodiment, which is the wellbore servicing method of the nineteenth embodiment, wherein the PCVT transitions from the second configuration to the third configuration upon the introduction of a second obturating member within the PCVT and the application of at least a pressure threshold onto the second obturating member.

While embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the embodiments of the present invention. The discussion of a reference in the Detailed Description of the Embodiments is not an admission that it is prior art to the present invention, especially any reference that may have a publication date after the priority date of this application. The disclosures of all patents, patent applications, and publications cited herein are hereby incorporated by reference, to the extent that they provide exemplary, procedural or other details supplementary to those set forth herein.

What is claimed is:

1. A pressure control valve tool (PCVT) adapted to be incorporated within a work string and configurable between first, second, and third configurations, the PCVT comprising:

a housing generally defining an axial flowbore and a lower contact surface extending circumferentially about the axial flowbore;

a first sleeve slidably positioned within the housing and moveable in an axial direction, and relative to the housing, from a first position to a second position;

a second sleeve slidably positioned within the first sleeve and moveable in the axial direction, and relative to the first sleeve, from a first position to a second position;

a flapper valve disposed within the axial flowbore and configurable between an activated state and an inactivated state, wherein, in the activated state, the flapper valve is free to move between a closed position, in which the flapper valve blocks the axial flowbore, and an open position, in which the flapper valve does not block the axial flowbore, and wherein, in the inactivated state, the flapper valve is retained in the open position by the second sleeve; and a body to which the flapper valve is hinged, the body comprising an upper contact surface extending circumferentially about the axial flowbore;

wherein, when the PCVT is in the first configuration, the first sleeve is in the first position relative to the housing, the second sleeve is in the first position relative to the first sleeve, and the flapper valve is in the activated state;

wherein, when the PCVT is in the second configuration, the first sleeve is in the second position relative to the housing and engaged with the upper contact surface, the second sleeve is in the first position relative to the first sleeve, and the flapper valve is in the inactivated state;

wherein, when the PCVT is in the third configuration, the first sleeve is in the second position relative to the housing, the second sleeve is in the second position relative to the first sleeve and engaged with the lower contact surface, and the flapper valve is in the activated state;

wherein engagement of a first obturating member with the first sleeve and application of at least a threshold pressure onto the first obturating member causes the PCVT to transition from the first configuration to the second configuration; and wherein engagement of a second obturating member with the second sleeve and application of at least a threshold pressure onto the second obturating member causes the PCVT to transition from the second configuration to the third configuration.

2. The PCVT of claim 1, wherein the first obturating member is sized to engage the first sleeve and not the second sleeve; and wherein the second obturating member is sized to engage the second sleeve and not the first sleeve.

3. The PCVT of claim 1, wherein, when the first sleeve is in the first position, the first sleeve is releasably coupled to the housing via a first retaining device comprising at least one of: a shear pin, a snap ring, and a biased pin.

4. The PCVT of claim 3, wherein, when the first sleeve is in the second position, the first sleeve is coupled to the housing via a snap ring.

5. The PCVT of claim 1, wherein, when the second sleeve is in the first position, relative to the first sleeve, the second sleeve is releasably coupled to the first sleeve via a second retaining device comprising at least one of: a shear pin, a snap ring, and a biased pin.

6. The PCVT of claim 5, wherein, when the second sleeve is in the second position, relative to the first sleeve, the second sleeve is not coupled to the first sleeve.

7. The PCVT of claim 1, wherein the PCVT comprises two or more flapper valves disposed within the axial flowbore and configurable between the activated state and the inactivated state.

8. The PCVT of claim 1, wherein the housing comprises first and second cylindrical bore surfaces, the first sleeve being slidably positioned against the first cylindrical bore surface, and the second cylindrical bore surface adjoining the lower contact surface.

9. The PCVT of claim 8, wherein, when the PCVT is in the second configuration, the first sleeve is engaged with each of the first cylindrical bore surface and the upper contact surface.

10. The PCVT of claim 8, wherein the first and second cylindrical bore surfaces define first and second diameters, respectively, the first diameter being greater than the second diameter.

11. The PCVT of claim 8, wherein the body further comprises a third cylindrical bore surface adjoining the upper contact surface; and wherein, when the PCVT is in the second configuration, the second sleeve is engaged with each of the second and third cylindrical bore surfaces.

12. The PCVT of claim 8, wherein, when the PCVT is in the third configuration, the second sleeve is engaged with each of the second cylindrical bore surface and the lower contact surface.

13. The PCVT of claim 8, further comprising a spacer disposed within the axial flowbore to retain the longitudinal position of the body within the housing, the spacer defining the first cylindrical bore surface.

* * * * *